US005169377A

United States Patent [19]

Schlip et al.

[11] Patent Number: 5,169,377

[45] Date of Patent: Dec. 8, 1992

[54] CENTRIFUGE FOR THE CONTINUOUS SEPARATION OF SUBSTANCES THAT DIFFER IN DENSITY

[75] Inventors: Reinhold Schlip, Woerthsee; Wolfgang Epper, Bergheim-Kenten, both of Fed. Rep. of Germany

[73] Assignee: Kloeckner-Humboldt-Deutz Aktiengesellschaft, Fed. Rep. of Germany

[21] Appl. No.: 502,687

[22] Filed: Apr. 2, 1990

[30] Foreign Application Priority Data

Apr. 7, 1989 [DE] Fed. Rep. of Germany ..... 3911320

[51] Int. Cl.[5] ..... B04B 1/10

[52] U.S. Cl. ..... 494/56; 414/53; 210/781

[58] Field of Search ..... 494/51-55, 494/57-59, 40, 41, 38, 56; 100/45; 210/781, 782

[56] References Cited

U.S. PATENT DOCUMENTS

| | | | |
|---|---|---|---|
| 3,092,338 | 6/1963 | Reinhall | 100/45 |
| 3,233,535 | 2/1966 | Fowlie | 494/56 |
| 3,555,999 | 1/1971 | Glowacki | 100/45 |
| 3,858,794 | 1/1975 | Nilson et al. | 494/53 |
| 3,989,536 | 11/1976 | Werner | 494/38 |
| 4,014,497 | 3/1977 | Spiewok et al. | 494/56 |
| 4,468,215 | 8/1984 | Wimmer | 494/56 |
| 4,710,159 | 12/1987 | Gullers | 494/56 |
| 4,784,634 | 11/1988 | Schiele | 494/52 |
| 4,915,851 | 4/1990 | Flory | 210/781 |

FOREIGN PATENT DOCUMENTS

| | | | |
|---|---|---|---|
| 1532711 | 4/1970 | Fed. Rep. of Germany | 494/51 |
| 2808677 | 9/1978 | Fed. Rep. of Germany | 494/56 |
| 3620912 | 12/1987 | Fed. Rep. of Germany . | |
| 3822983 | 1/1990 | Fed. Rep. of Germany | 494/53 |

*Primary Examiner*—Harvey C. Hornsby
*Assistant Examiner*—James F. Hook
*Attorney, Agent, or Firm*—Hill, Van Santen, Steadman & Simpson

[57] ABSTRACT

A rotary centrifuge for the separation of substances at different density having an outer cylindrical housing and a worm within the housing and the worm and housing driven at different rotational speeds, the housing having an opening for the discharge of the heavier fraction with the opening controlled by an external control element preferably stationarily supported and connected by a linkage to a movable valve member for controlling the opening, preferably a ring which moves axially to change the size of an annular discharge gap between the ring and a circular discharge opening in the end wall of the drum, but the opening can also be in the form of axial radial facing openings controlled by a movable valve member.

8 Claims, 4 Drawing Sheets

CENTRIFUGE FOR THE CONTINUOUS SEPARATION OF SUBSTANCES THAT DIFFER IN DENSITY

BACKGROUND OF THE INVENTION

The invention relates to a centrifuge for the continuous separation of substances that differ in density, particularly for separating solid-liquid mixtures. More particularly, the centrifuge comprises an essentially cylindrically shaped drum with nozzles arranged in the discharge region for the thick substances. The discharge region openings through which the thick substance is discharged, and control elements that cooperate with an adjustment means arranged outside of the centrifuge drum are provided for opening and closing the nozzle openings.

German Published Application 36 20 912 discloses a centrifuge for the continuous separation of substances that differ in density which conforms to the above type, with control elements that accomplish the opening and closing of the nozzles arranged inside the centrifuge drum. Piston-cylinder units are also provided as adjustment agents to which bores, that are arranged in the end wall and in the drive shaft of the centrifuge drum, are connected. These bores lead to the outside and serve as hydraulic fluid lines that are charged with hydraulic fluid from the outside. This known mechanism for opening and closing the nozzles is not only relatively complicated in terms of structure, but repair thereof, particularly the replacement of worn control elements for new control elements, involves a relatively great expenditure of work, time and money since the centrifuge not only has to be stopped for this purpose, but for thick material, the centrifuge drum must also be opened in the region of the discharge. Moreover, the delivery of the hydraulic fluid to the control elements arranged inside the centrifuge drum is accompanied by sealing problems that are extremely difficult to govern, particularly in the region of the rotary transmission lead-through.

An object of the invention is to considerably simplify the discharge of thick material from the centrifuge independently of the speed of the conveyor worm and/or of the differential speed between conveyor worm and centrifuge drum.

A further object of the invention is to provide an improved rotary centrifuge separating a mixture of solids and liquids which avoids the disadvantages existent in structures and arrangements of the type heretofore available to the art.

FEATURES OF THE INVENTION

The objectives of the invention are achieved in that the control elements for opening and closing the nozzle apertures are arranged at the outside of the centrifuge drum and are in interactive connection with the adjustment means by mechanical link elements. In that the control elements for opening and closing the nozzle apertures are arranged at the outside of the centrifuge drum, maintenance and function checking of the control elements are considerably facilitated. Also, the replacement of worn control elements for new control elements is significantly simplified since the centrifuge drum need not be dismantled and opened for this purpose. Being that the control elements are in an interactive connection with the adjustment means by mechanical link elements, no sealing problems arise. Complicated and expensive bores in the drive shaft and in the end wall of the centrifuge drum for the hydraulic fluid delivery for actuating the control elements are eliminated in comparison to known centrifuges of a similar type, and this leads to a considerable reduction of the manufacturing and maintenance costs of the discharge means for the thick material.

In a further advantage of the invention, the control element comprises a ring wheel that rotates with the centrifuge drum and is arranged in an axially displaceable manner on the drive shaft of the centrifuge drum, and this ring wheel is in an interactive connection with a displacement means arranged on the bearing housing of the centrifuge. This control or adjustment element, arranged in axially displaceable manner on the drive shaft of the centrifuge drum, is particularly advantageous due to its simple design and high reliability.

Other objects, advantages and features of the invention will become more apparent with the teaching of the principles thereof in connection with the disclosure of the preferred embodiment in the specification, claims and drawings in which:

DESCRIPTION OF THE PREFERRED EMBODIMENT

Figure 1:
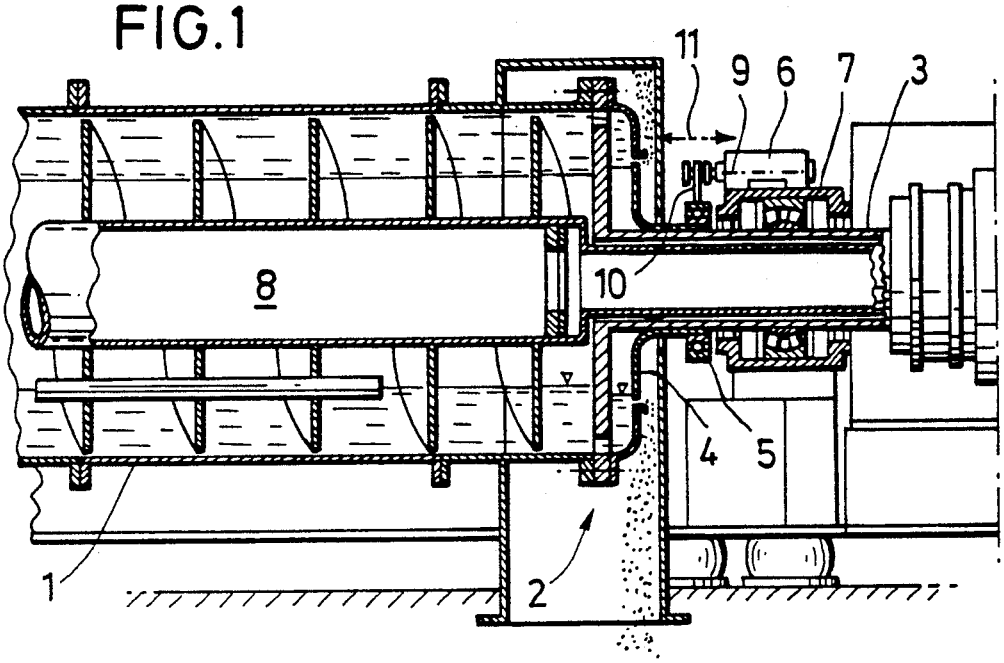
FIG. 1 is a vertical section taken substantially through the axis of a centrifugal separator constructed and operating in accordance with the principles of the present invention.
Figure 2:
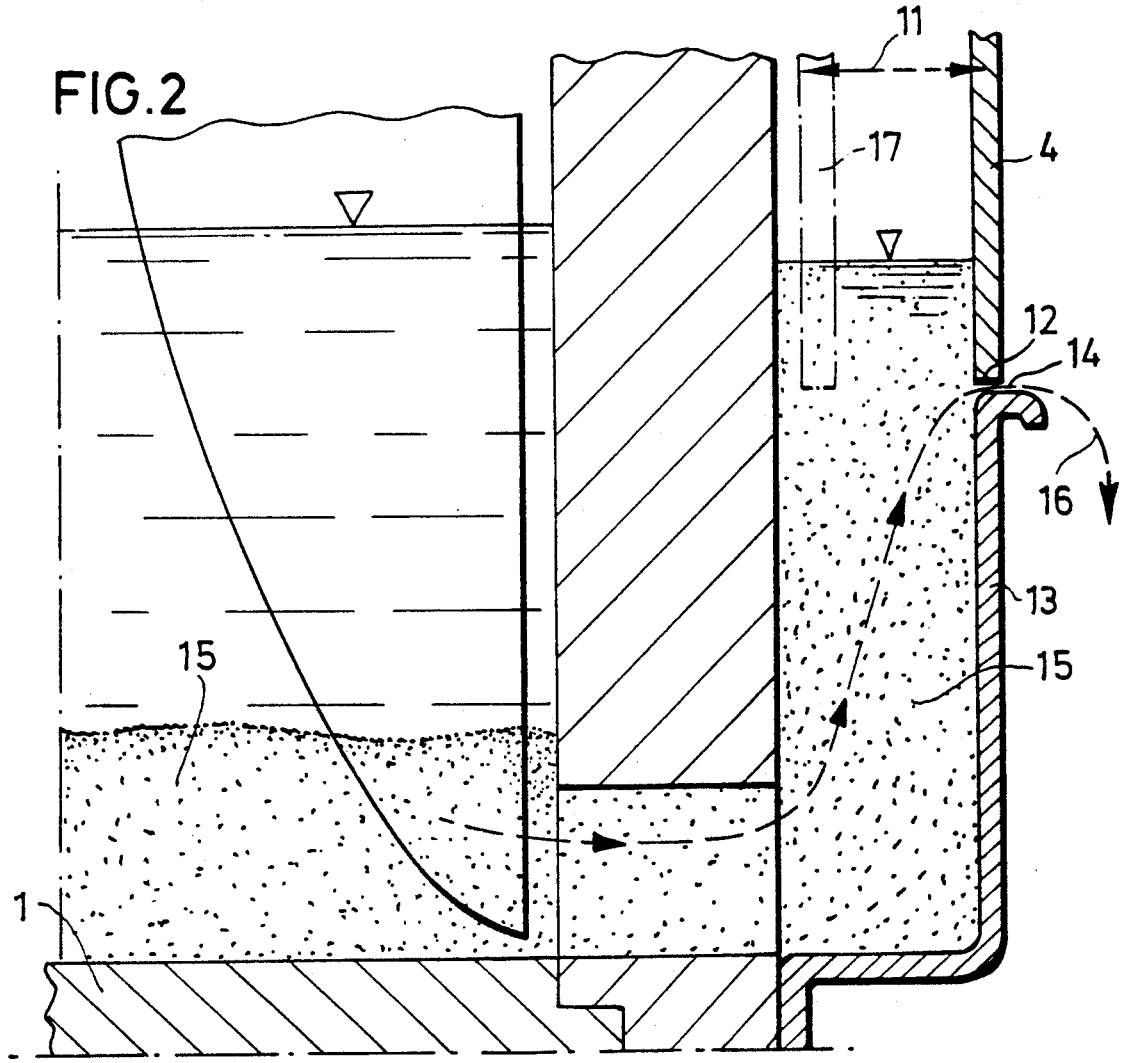
FIG. 2 is a fragmentary enlarged sectional view of a portion of the centrifuge of FIG. 1.

As FIGS. 1 and 2 show, a centrifuge drum 1 of a solid bowl worm centrifuge has a discharge region 2 for thick material. The drum is provided with a ring 4 that is axially displaceable in the direction of arrowed line 11 on a drive shaft 3 of the centrifuge drum and the ring rotates together with the centrifuge drum during operation of the centrifuge. The ring 4 is in an interactive connection with an adjustment means 6 by a displacement bearing 5. This adjustment means 6 is arranged on a bearing housing 7 in which the drive shaft 3 of the centrifuge drum 1 and a conveyor worm 8 are rotationally seated.

The adjustment means 6 can be constructed as a double-acting, hydraulic piston-cylinder unit with a piston rod 9 having its outer end connected to a plate-shaped element 10 that is attached to the outer bearing ring of the displacement bearing 5. The adjustment means 6, however, can also be advantageously constructed as an electric motor having a screw spindle arranged at the rotor that engages into a corresponding adjustment thread in the element 10 for the purpose of axial adjustment of the ring 4 in the direction of the arrowed line 11.

The outside edge 12 of the ring 4 forms an annular gap 14, FIG. 2, together with the end wall 13 of the centrifuge drum 1 through which the thick material 15 separated from the liquid in the centrifuge drum during operation of the centrifuge emerges.

The annular gap 14 can have its width continuously adjusted by axial displacement as far as the position 17 shown with broken lines in FIG. 2, and thereby be adjusted with the assistance of the ring 4 that serves as a control element for opening and closing the annular nozzle apertures. This enables an optimum control of the discharge of thick material from the centrifuge drum, not only dependent on the concentration of solids and/or thick material supplied to the centrifuge; but also the desired degree of slurry thickening can also be influenced from the outside in a simple way and independently of the operating condition of the centrifuge. The axially displaceable ring 4 for controlling the discharge annular gap 14 for the thick material 15 can, as needed, be kept regulated in a defined gap width position but can also be opened or closed with infinite variation by a time pulse control.

Figure 3:
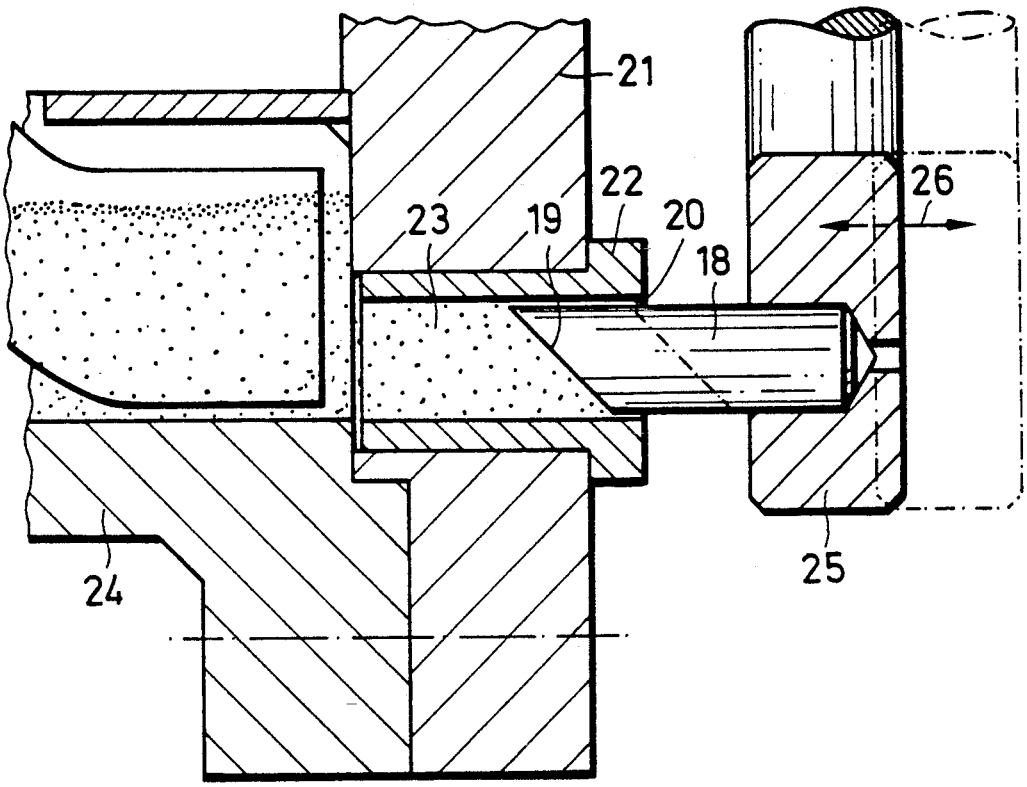
FIG. 3 is a fragmentary enlarged sectional view of a portion of the centrifuge illustrating the features of a nozzle control element.

The control element shown in FIG. 3 consists of one or more plungers 18 having a bevelled end face 19 that controllably regulates and/or releases or closes the opening 20 of the nozzles 22. The members are arranged in the end wall 21 for the discharge of the thick material 23 from the centrifuge drum 24. The plunger 18 serves as a control and closing element and is detachably connected to a ring arm 25 that, as a mechanical link element to the adjustment means, is arranged on the drive shaft of the centrifuge drum and which proceeds radially and adjustable in an axial manner as shown by the arrowed line 26. The adjustment mechanism to which the ring arm 25 is connected corresponds to the adjustment means 5, 6, 9, 10 shown in FIG. 1 and is not shown in greater detail in FIG. 3.

Figure 4:
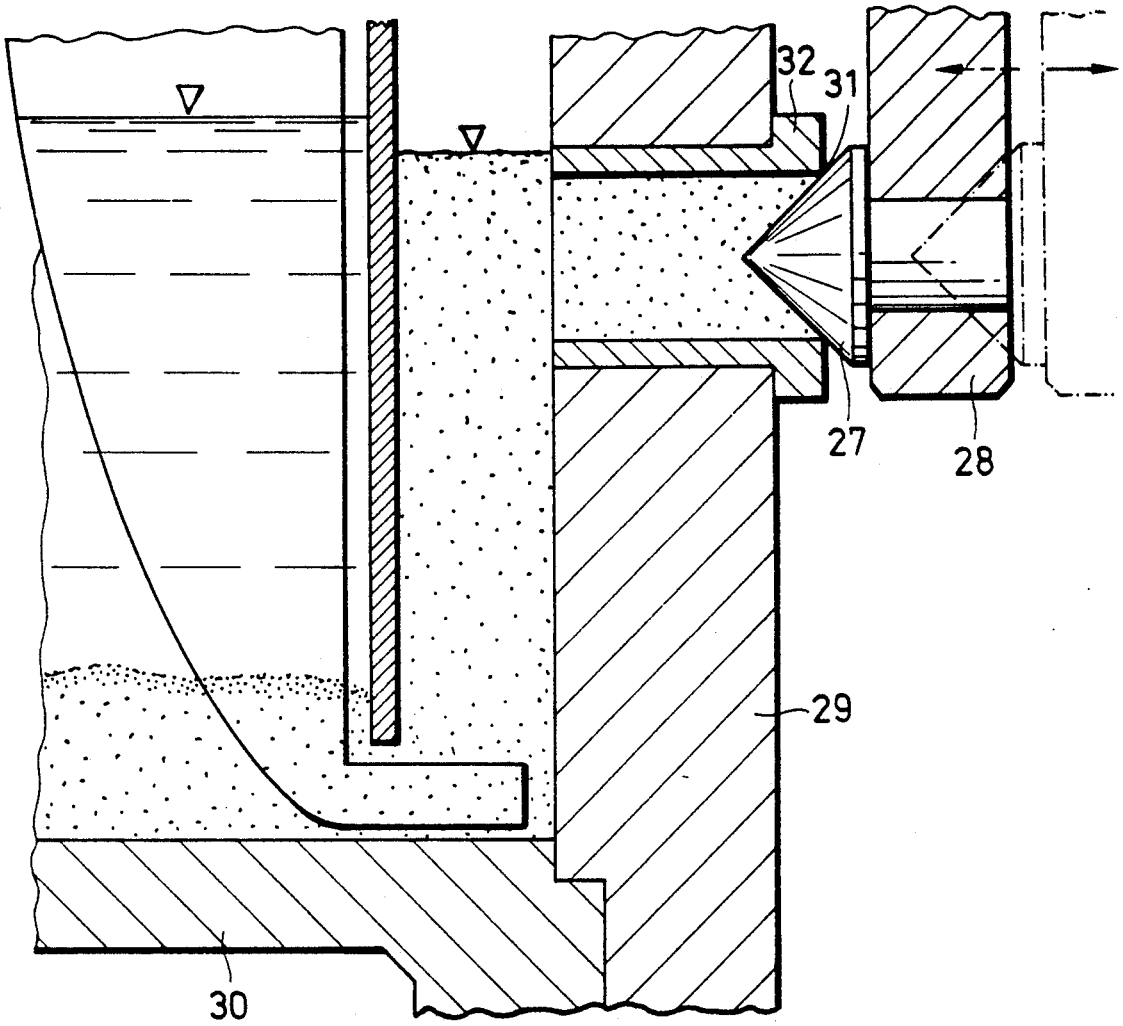
FIG. 4 is a fragmentary sectional detailed view illustrating features of the nozzle control.

In the exemplary embodiment shown in FIG. 4, the conically shaped control element 27 which is detachably connected to an arm 28 and which is axially displaceable on the drive shaft of the centrifuge drum and extends radially outward. The opening and closing of the aperture 31 of the nozzle 32 arranged in the end wall 29 of the centrifuge drum 30 ensues in the same way as in the discharge means for thick material shown in FIG. 3.

Figure 5:
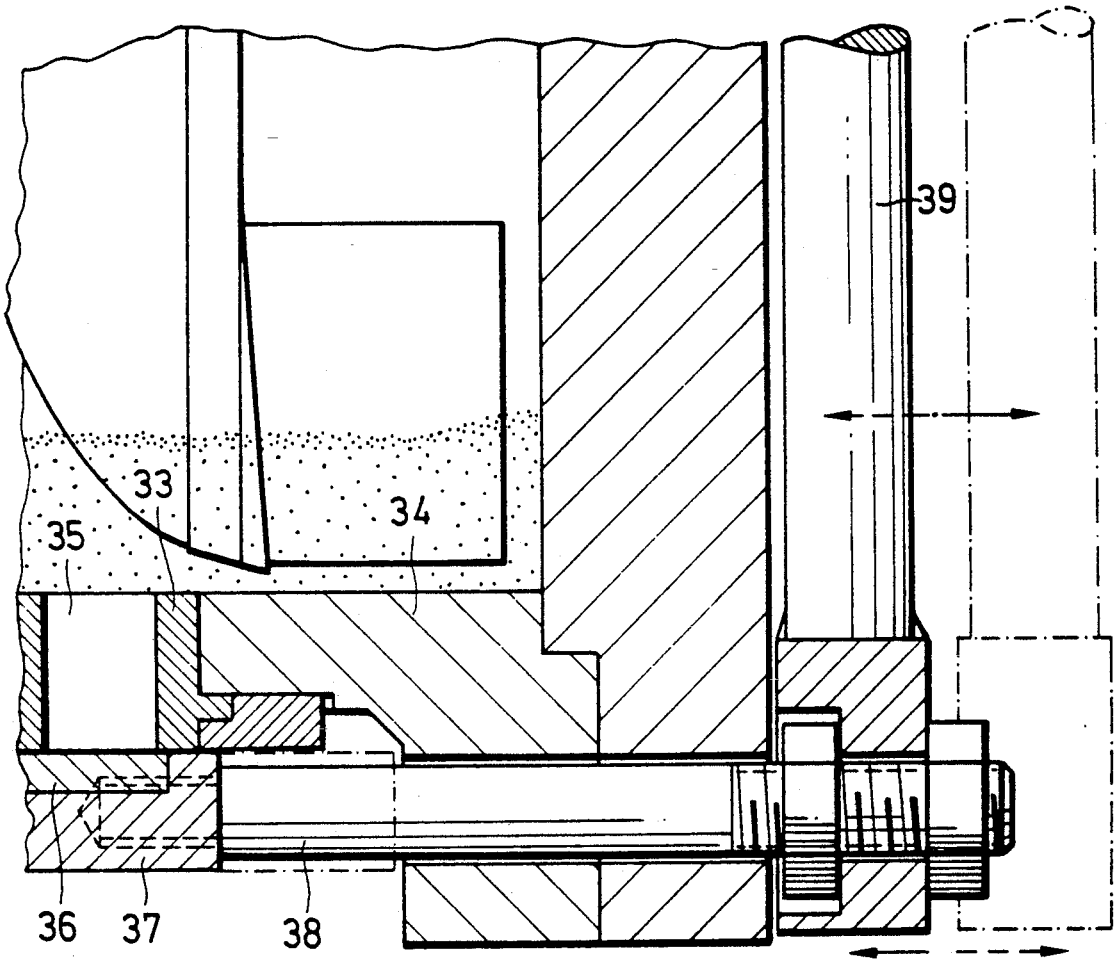
FIG. 5 is a further fragmentary sectional view of the centrifuge for illustrating a feature of the control.

According to FIG. 5, nozzles 33 are arranged in the drum jacket 34 and are uniformly distributed over the circumference thereof. Plate shaped control elements 36 are provided for opening and closing nozzle apertures 35, and these control elements are secured in a ring 37 that embraces the drum. Slide rods 38 attack at the ring 37, and these slide rods 38 are in turn rigidly connected to arms 39 that extend radially outwardly and are axially movable on the drive shaft of the centrifuge drum 34.

All of these control elements for opening and closing the nozzle apertures as shown in the figures of the drawing, constructed in accordance with the invention and arranged at the outside of the centrifuge drum and residing in interactive connection with the adjustment means by mechanical link elements, are particularly advantageous in that they are structurally simple, are always reliable and are easily accessible from the outside at any time. They can also be quickly replaced as needed. A further and very critical advantage of the control elements arranged at the outside of the centrifuge in accordance with the invention resides in that blockages of the nozzles are reliably prevented. Moreover, there is also the possibility of a mechanical connection of existing control elements arranged inside the centrifuge drum with the control mechanism situated outside the drum, namely by simple roddings and angle levers that are preferably arranged at the end wall of the drum. Moreover, the inventively constructed control elements in interactive connection with the adjustment means advantageously enable an exact, optimum and infinitely variable adjustment of the discharge openings for the thick material dependent on the concentration of the thick material concentrated in the centrifuge.

We claim as our invention:

1. A centrifugal separator for the continuous separation of materials at different density, comprising in combination:

a rotatably supported centrifugal separator drum having an annular shell and radial end walls and mounted for rotation on a horizontal axis and having an opening in one of said radial end walls for a discharge of a thicker fraction of material from the drum;

a movable control element for continuously adjusting the size of the opening and regulating the flow of thicker fraction of material;

an auger within the drum moving the thicker fraction toward the opening;

an operator located externally of the drum;

and a direct mechanical connector between said separator and said control element for transmitting movement from the operator to the control element and regulating the discharge of said thicker fraction being adjustable during rotational operation of the drum.

2. A centrifugal separator for the continuous separation of materials at different density constructed in accordance with claim 1:

wherein said control element is an annular ring supported on the drum to co-rotate therewith and movable axially relative to the opening regulating the flow of the thicker fraction of material.

3. A centrifugal separator for the continuous separation of materials at different density constructed in accordance with claim 1:

wherein said mechanical connection is in the form of a radially outwardly extending arm with a means for adjusting the arm in an axial direction to change the effect of the control element relative to the opening.

4. A centrifugal separator for the continuous separation of materials at different density constructed in accordance with claim 1:

wherein said movable control element is disk shaped.

5. A centrifugal separator for the continuous separation of materials at different density constructed in accordance with claim 1:

wherein said control element is plate shaped with a flat surface coacting with the opening.

6. A centrifugal separator for the continuous separation of materials at different density constructed in accordance with claim 1:

wherein said opening is defined by an annular end wall having a circular inner opening and the control element is a plate movable relative to said opening.

7. A centrifugal separator for the continuous separation of materials at different density constructed in accordance with claim 1:

wherein said opening is defined by an annular slot between first and second end wall elements of the separator drum with one of the end wall elements movable axially relative to the other to provide the control element.

8. A centrifugal separator for the continuous separation of material at different density, comprising in combination:

a rotatably supported cylindrical separation drum having an annular end dam therein with an annular radially inwardly facing edge over which a thicker fraction of material flows;

a space axially outwardly of the end dam for the passage of said thicker fraction into said space;

a rotatable auger within the drum capable of being driven at a rotatable speed independent of the drum and moving the thicker fraction to the end dam;

an annular end wall outwardly of said space with an opening communicating with said space for the release of the thicker fraction of material;

a ring situated within the opening in the end wall defining an annular gap between the ring and edge of the end dam variable in size as the ring moves axially relative to the end wall;

an annular bearing having an inner rotatable portion connected to the ring and an outer portion rotatably stationary but axially movable;

a control motor mounted externally of the drum and having an axially movable output control;

a radially extending link connected between the outer portion of the bearing and the control for moving the ring axially to control the size of the gap;

and adjustment means between the motor and the link for varying the controlled position of the ring.

* * * * *